US011492801B2

(12) United States Patent
Vasquez et al.

(10) Patent No.: US 11,492,801 B2
(45) Date of Patent: Nov. 8, 2022

(54) MODULAR WALL UNIT

(71) Applicant: Vistafolia Limited, Camberley (GB)

(72) Inventors: Alberto Vasquez, Piedecuesta (CO); Ariadnne Diaz, Camberley (GB); Declan Martin, Fareham (GB); Richard Lumb, Camberley (GB); Paul Alder, Camberley (GB)

(73) Assignee: Vistafolia Limited, Camberley (GB)

( * ) Notice: Subject to any disclaimer, the term of this patent is extended or adjusted under 35 U.S.C. 154(b) by 0 days.

(21) Appl. No.: 17/432,814

(22) PCT Filed: Nov. 27, 2020

(86) PCT No.: PCT/GB2020/053051
§ 371 (c)(1),
(2) Date: Aug. 20, 2021

(87) PCT Pub. No.: WO2021/105713
PCT Pub. Date: Jun. 3, 2021

(65) Prior Publication Data

US 2022/0042302 A1 Feb. 10, 2022

(30) Foreign Application Priority Data

Nov. 29, 2019 (GB) ..... 1917503

(51) Int. Cl.
*E04B 2/10* (2006.01)
*E04B 2/20* (2006.01)
(Continued)

(52) U.S. Cl.
CPC ..... *E04B 2/10* (2013.01); *E04B 2/20* (2013.01); *E04C 1/40* (2013.01); *E04B 2002/0245* (2013.01)

(58) Field of Classification Search
CPC ..... E04C 2002/001; E04C 1/40; E04B 1/61; E04B 2002/0243; E04B 2002/0245; E04B 2/10; E04B 2/20; E04B 2/16; E04B 2/02
See application file for complete search history.

(56) References Cited

U.S. PATENT DOCUMENTS 1,761,848 A 6/1930 Sitzman
2,106,177 A * 1/1938 Hultquist ..... E04B 2/52 52/308

(Continued)

FOREIGN PATENT DOCUMENTS

CN 111021583 A 4/2020
DE 20 2007 005 649 U1 9/2007

(Continued)

OTHER PUBLICATIONS

International Search Report for Application No. PCT/GB2020/053051, dated Mar. 5, 2021, 4 pgs.

(Continued)

*Primary Examiner* — Jessica L Laux
(74) *Attorney, Agent, or Firm* — Young Basile Hanlon & MacFarlane, P.C.

(57) ABSTRACT

A modular wall unit for a modular wall system includes a first elongate reinforcement member comprising at least one tubular portion for connecting the wall unit to a further wall unit of the wall system. The wall unit also includes a body at least partially surrounding the reinforcement member along its elongate length. The reinforcement member provides strength to the wall unit and allows a connecting element to engage with the at least one tubular portion. The connecting element can connect the wall unit to a further wall unit. This allows formation of a wall system where multiple wall units are interconnected via the reinforcement members and connecting elements. A kit including a wall unit and one or more plugs for assembling a plurality of wall (Continued)

units, a method for forming a wall unit, and a hanging device for supporting a frame are also described.

16 Claims, 14 Drawing Sheets

(51) Int. Cl.
*E04C 1/40* (2006.01)
*E04B 2/02* (2006.01)

(56) References Cited

U.S. PATENT DOCUMENTS 2,392,551 A * 1/1946 Roe ..... E04B 2/08 52/592.6
2,929,236 A * 3/1960 Steward ..... E04B 2/20 52/223.3
2,963,828 A * 12/1960 Belliveau ..... E04B 2/08 52/564
3,170,267 A * 2/1965 Rosenfeld ..... E04B 2/10 52/438
3,296,758 A * 1/1967 Kundsen ..... E04B 2/10 52/223.7
3,305,991 A 2/1967 Weismann
4,793,104 A * 12/1988 Hultberg ..... E04C 1/42 52/127.3
5,372,346 A 12/1994 Upchurch et al.
5,402,609 A * 4/1995 Kelley, Jr. ..... E04B 2/32 52/561
5,802,792 A * 9/1998 Fielding ..... E04B 2/18 52/396.08
5,809,732 A 9/1998 Farmer, Sr. et al.
6,138,426 A * 10/2000 Mork ..... E04B 2/14 52/561
6,178,714 B1 * 1/2001 Carney, Jr. ..... E04B 2/16 52/564
6,299,001 B1 10/2001 Frolov et al.
6,412,243 B1 * 7/2002 Sutelan ..... E04B 7/102 52/783.17
6,539,682 B1 * 4/2003 Ryder ..... E04B 2/18 52/505
8,266,862 B2 * 9/2012 Huang ..... E04C 2/044 52/436
9,303,400 B2 * 4/2016 Maeers ..... E04B 2/16
10,760,273 B1 * 9/2020 Alexander ..... E04B 1/41
2006/0156656 A1 * 7/2006 Robinson ..... E04B 2/16 52/220.2
2007/0114349 A1 5/2007 Lawson et al.
2010/0219307 A1 9/2010 Ernst et al.
2015/0159376 A1 6/2015 Biadora
2016/0076246 A1 * 3/2016 Romanenko ..... E04C 1/397 52/601
2017/0335567 A1 * 11/2017 Chugh ..... E04C 2/526
2019/0153741 A1 * 5/2019 Monk ..... E04C 2/08
2020/0284031 A1 * 9/2020 Berkowitz ..... E04B 2/7425

FOREIGN PATENT DOCUMENTS

FR 1232541 A * 10/1960
FR 1232541 A 10/1960
FR 2 333 473 A1 7/1977
FR 3 057 585 A1 4/2018
WO 2010/100534 A2 9/2010
WO 2012/034224 A1 3/2012

OTHER PUBLICATIONS

Examination Report in Application No. GB1917503.3, dated Oct. 5, 2020, 14 pgs.
Response made to Report under Section 18(3) in Application No. GB1917503 3, dated Nov. 16, 2020, and amended claims, 4 pgs.

* cited by examiner

MODULAR WALL UNIT

TECHNICAL FIELD

The present invention relates to a modular wall unit for a modular wall system. In particular, but not exclusively, the present invention relates to a modular wall unit having an internal reinforcement member giving strength to the unit and allowing the modular wall unit to connect to further wall units to form an overall wall.

BACKGROUND

Typically, known systems for building a temporary wall involve blocks each having one or more holes running through the block and being configured to receive a rod such that multiple blocks are held together by the rod.

For example, one known system (U.S. Pat. No. 6,178,714 B1) comprises a foundation of poured, levelled concrete having regularly spaced holes for vertical block assembly rods, a plurality of walls blocks where each block has one or more vertical block assembly holes running entirely though the blocks, and a plurality of block assembly rods. When a column of one or more wall blocks is placed on the foundation with the foundation and block holes aligned, one or more block assembly rods can be run through the block column and into the foundation. This enables an assembly of a temporary wall with blocks, rods, and foundation that does not require mortar and is easy to disassemble.

BRIEF SUMMARY

A problem with the above-described system is that the block assembly rod that is run through each block of a column is subject to bending and therefore likely to be damaged easily and require frequent replacement. Another problem is that the block assembly rod provides vertical structural support only, which means the temporary wall can be prone to toppling and instability.

The present invention aims to overcome or at least partly mitigate one or more of the above problems.

According to a first aspect of the present invention, there is provided a modular wall unit for a modular wall system, the modular wall unit comprising a body having first and second outer wall faces, first and second joining faces that each extend between the first and second outer wall faces, at least one of the first and second joining faces for facing a joining face of a further modular wall unit of the modular wall system, and a first through-hole extending between the first and second joining faces. The modular wall unit further comprises a first elongate reinforcement member extending between the first joining face and the second joining face and within the first through hole, the first elongate reinforcement member having at least one tubular portion proximal to a terminating end of the first elongate reinforcement member. The first aspect may be modified according to any suitable teaching described herein, including, but not limited to, any one or more of the following optional features.

The modular wall unit may further comprise a second through hole, spaced apart from the first through hole and extending between the first and second joining faces. The modular wall unit may further comprise a second elongate reinforcement member extending between the first face and the second face and within the second through hole, the second elongate reinforcement member having at least one tubular portion proximal to a terminating end of the second elongate reinforcement member.

The modular wall unit may be configured such that the body further comprises an internal recess extending away from and adjoining the first through hole. The modular wall unit may further comprise a third elongate reinforcement member that resides in the recess, and is connected to the first elongate reinforcement member.

The modular wall unit may be configured such that the internal recess extends at least between the first through hole and the second through hole, and the second elongate reinforcement member further connects to the third elongate support member.

The body portion may comprise a foam material.

The part of the body portion surrounding the reinforcement members may be unitary.

Any of the said elongate reinforcement members may comprise Aluminium.

Any one or more of the said elongate reinforcing members may comprise a tubular portion proximal at both terminating ends.

Any one or more of the one or more of the elongate reinforcement members may comprise a tube running the entire length of the respective reinforcement member.

The modular wall unit may further comprise one or more supporting members extending outwardly from an outer wall face.

The one or more support members may comprise an elongate portion and a head portion terminating the one or more support members at a distal end away from the modular wall unit.

The elongate portion may have a maximum diameter that is smaller than the maximum diameter of the head portion.

The modular wall unit may further comprise a further support member extending from the second reinforcement member.

The support member may extend substantially perpendicular from the first or second reinforcement members.

The first and second joining faces may be planar.

Alternatively, the first and second joining faces may be parallel.

According to a second aspect of the present invention, there is provided a kit comprising a modular wall unit as described above in respect of the first aspect of the present invention, and one or more plugs for assembling a plurality of modular wall units.

According to a third aspect of the present invention, there is provided a modular wall system comprising a plurality of modular wall units.

According to a fourth aspect of the present invention, there is provided a modular wall unit for a modular wall system, the modular wall unit comprising a first elongate reinforcement member comprising at least one tubular portion for connecting the modular wall unit to a further modular wall unit of the modular wall system. The modular wall unit further comprises a body at least partially surrounding the first elongate reinforcement member along its elongate length. The fourth aspect may be modified according to any suitable teaching described herein, including but not limited to, any one or more of the technical features describing the first aspect, and/or any one or more of the following optional features.

The body may be a block that houses the first elongate reinforcement member.

The body may comprise foam.

The first elongate reinforcement member may form part of a reinforcement frame comprising a plurality of elongate reinforcement members, the plurality of elongate reinforcement members at least partially surrounding the body along their respective elongate lengths.

The frame may comprise an H-shaped frame.

At least the first elongate reinforcement member may extend between first and second outer faces of the body.

According to a fifth aspect of the present invention, there is provided a method for forming a modular wall unit, the method comprising inserting a first elongate reinforcement member into a mold, and filling the mold, at least partially with material. The fifth aspect may be modified according to any suitable teaching described herein, including but not limited to any one or more of the following optional features.

Inserting a first elongate reinforcement member into a mold may include inserting a reinforcement frame into the mold, the frame comprising a plurality of elongate reinforcement members, and filling the mold at least partially with material may include filling the mold with a liquid foam material.

Inserting the reinforcement frame into the mold may comprise inserting an H-shaped frame into the mold, the mold being configured to hold the H-shaped frame in a predetermined position.

Filling the mold may comprise filling the mold at least partially with foam material.

Filling the mold may comprise filling the mold completely with foam material.

Filling the mold may comprise filling the mold completely with liquid foam material.

The method may further comprise the foam material self-expanding to fill voids within the mold to form the body portion of the modular wall unit. the body portion surrounding the H-shaped frame.

The method may include any one or more of the following steps (in any order): setting the liquid foam material, for example by an external treatment or by allowing the foam to set; and plugging any open tubular ends of the reinforcement members.

The method according to the fifth aspect of the present invention may be for forming the modular wall unit as described above in respect of the first aspect or fourth aspect of the present invention.

According to a sixth aspect of the present invention, there is provided a hanging device for supporting a frame; the hanging device comprising a main body comprising an engagement region (81) for engaging a headed fixing that passes through the main body; spaced apart first and second arms connected to, and arranged with, the main body to form respective first and second hook portions for supporting the frame; the engagement region being at least partially between the first and second hook portions. The sixth aspect may be modified according to any suitable teaching described herein, including but not limited to, any one or more of the following optional features.

The first and second hook portions may form a channel extending at least: from, and including, the first hook portion; to, and including, the second hook portion; the engagement region faces the channel.

The engagement region may be recessed inwardly from a wall of the main body forming the channel.

The engagement region may be located about a portion of the said main body channel wall that is proximal to the base of the channel.

The frame may comprise a first bar perpendicularly extending to and connected to a second bar; the said channel is for supporting the first bar; the main body comprises a recessed second channel at least partially accommodating the second bar.

At least part of the engagement region may be aligned along the length of second channel.

At least one of the arms may comprise a through hole; the main body comprising a fixing recess, the through hole and the fixing recess being aligned such that a further fixing may be inserted through the through hole and at least partially into the fixing recess.

Within the scope of this application it is expressly intended that the various aspects, examples, and alternatives set out in the preceding paragraphs, in the claims and/or in the following description and drawings, and in particular the individual features thereof, may be taken independently or in any combination. That is, all examples and/or features of any example can be combined in any way and/or combination, unless such features are incompatible.

BRIEF DESCRIPTION OF THE DRAWINGS

The present invention will now be described, by way of example only, with reference to the accompanying drawings.

DETAILED DESCRIPTION

Modular Wall Unit

There is presented a modular wall unit for a modular wall system. It should be noted that features of the different examples of the modular wall unit and the method for making a modular wall unit may also be used in other examples of the same, either as an addition or as a replacement of a technical feature or step.

Figure 1A:
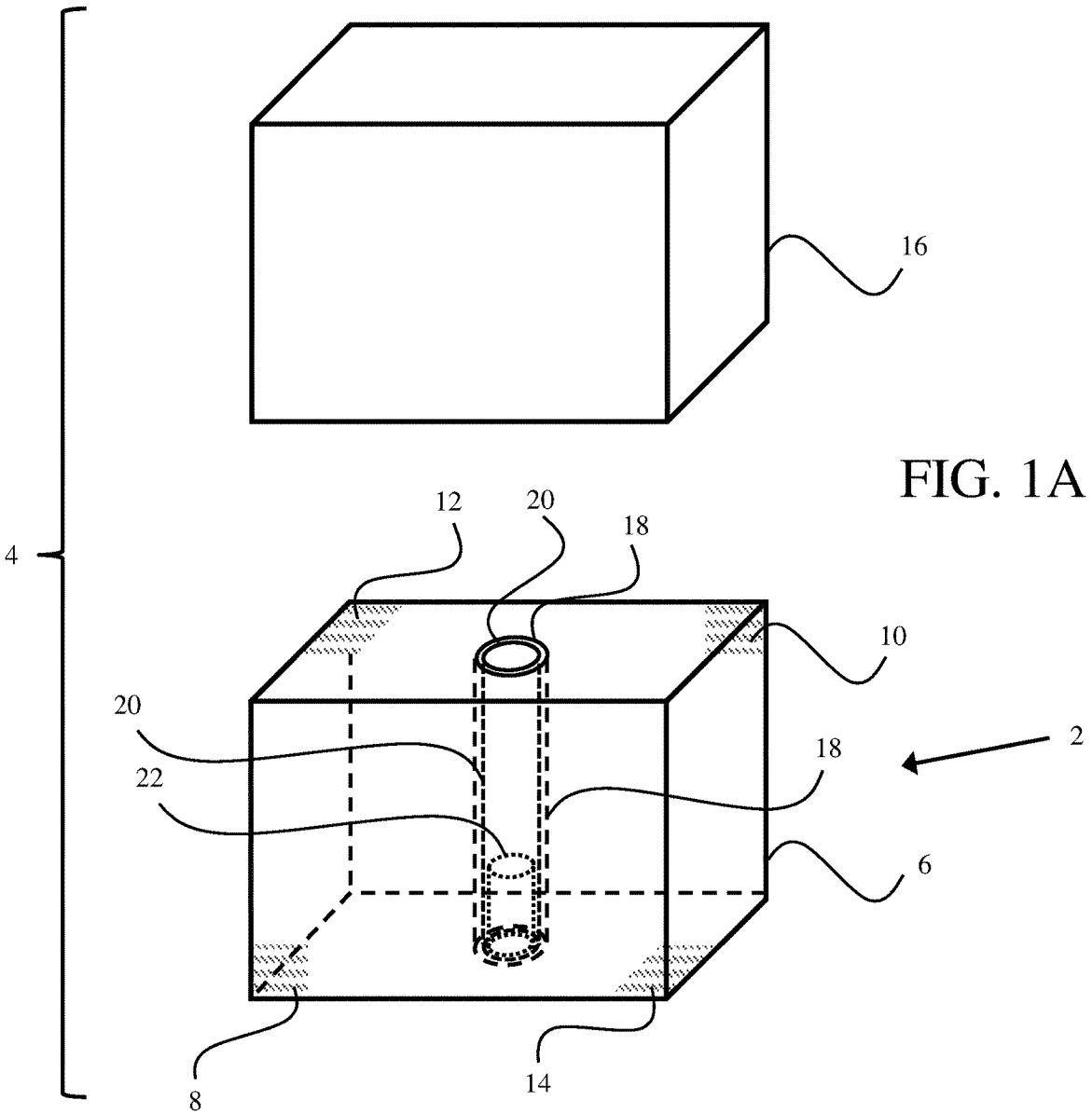
FIG. 1A is a schematic diagram showing a perspective view of a modular wall unit for a modular wall system.

FIG. 1A shows an example of a modular wall unit.

There is presented a modular wall unit 2 for a modular wall system 4. The modular wall unit 2 comprises a body 6. The body 6 has first 8 and second 10 outer wall faces. The body 6 also has first 12 and second 14 joining faces that each extend between the first 8 and second 10 outer wall faces. At least one of the first 12 and second 14 joining faces are for facing a joining face of a further modular wall unit 16 of the modular wall system 4. The body 6 also has a first through-hole 18 extending between the first 12 and second 14 joining faces. The modular wall unit 2 further comprises a first elongate reinforcement member 20 extending between the first joining face 12 and the second joining face 14 and within the first through hole 18. The first elongate reinforcement member 20 also has at least one tubular portion 22 proximal to a terminating end of the first elongate reinforcement member 20.

For purposes of discussing the modular wall system, the modular wall unit described above may be referred to as the 'first modular wall unit' or 'first unit' hereinafter. Likewise, the further modular wall unit may be referred to as the further unit. The modular wall system may be referred to as the 'wall system' or 'system' and may have a plurality of units wherein the system forms a 'wall'. The further units may also be referred to a first, second third units etc. when discussing examples of the system.

The modular wall unit 2 therefore has an internal reinforcement member 20 giving strength to the unit 2 but that allows for a connecting element to be inserted into the through hole 18 and engage with the tubular end portion 22, for example by an interference fit. The connecting element may be used to connect with other portions of the wall system 4, for example with further wall units or other units such as a base unit. The further adjacent modular wall unit abutting the first unit along respective joining faces may have its terminating tubular portion at the joining surface facing the first unit. This allows the wall system to be interconnected via the internal reinforcement members. The connecting element may for example be a connecting plug, pin or other suitable means as described elsewhere herein.

Modular Wall System and Uses

Figure 1B:
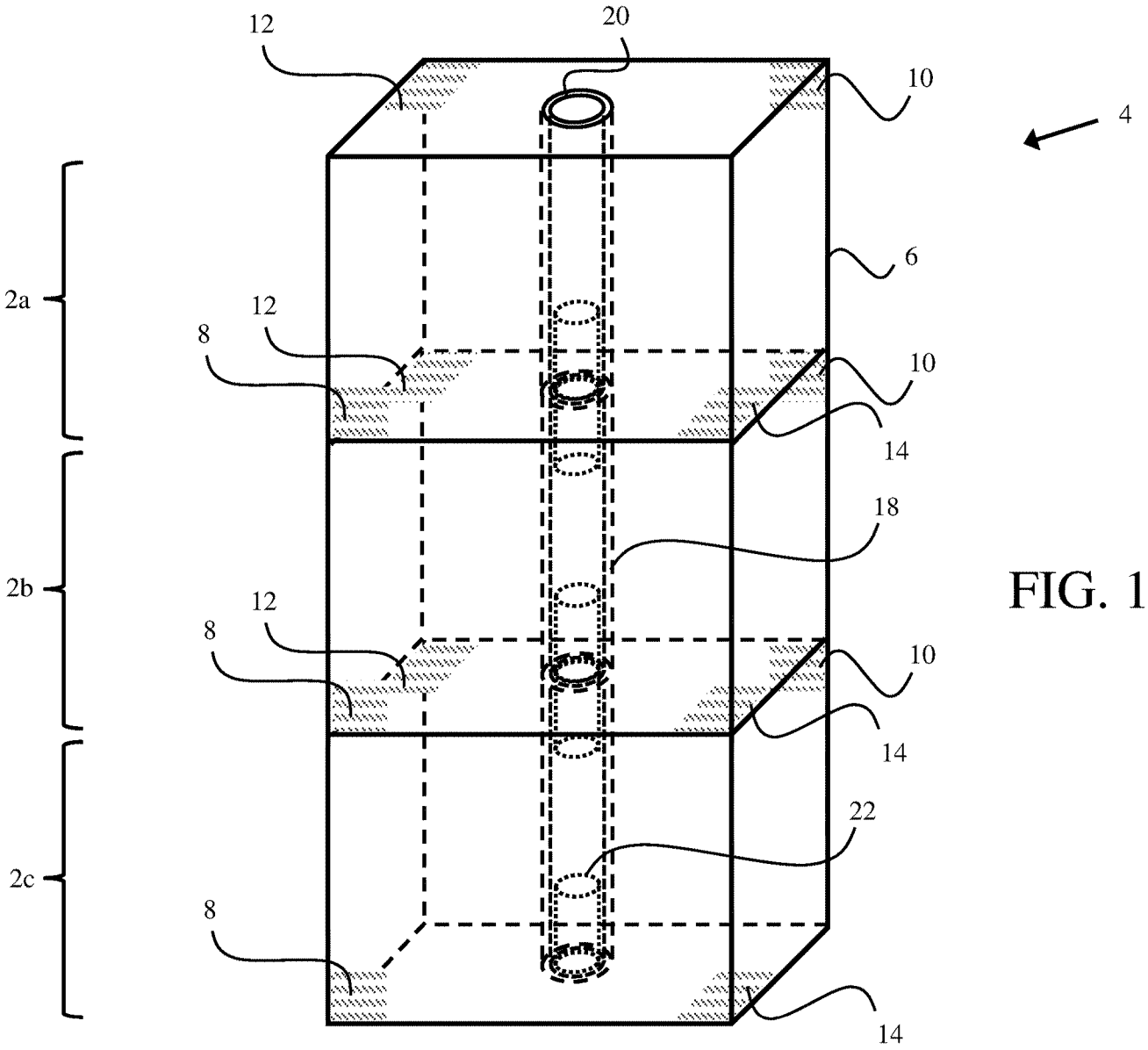
FIG. 1B is a schematic diagram showing a perspective view of a modular wall system comprising a plurality of modular wall units.

FIG. 1B shows a modular wall system 4 comprising a plurality of units 2*a*, 2*b*, 2*c* stacked on top of each other to form a three unit high, one unit wide wall. The internal reinforcement member 20 of each of the units 2*a*, 2*b*, 2*c* has at least one tubular portion 22 proximal to at least one of the terminating ends of the internal reinforcement member 20. In this example the bottom two units 2*b*, 2*c*, have a separate tubular portion at each respective terminating end, whilst the top unit 2*a* only has a tubular portion of its reinforcement member adjacent to the middle wall unit 2*b*. The wall units are stacked so that the elongate reinforcement members are longitudinally aligned. This allows for a connecting element (not shown) to be inserted into the through hole 18 and the tubular portion of one of the units 2*a* and the tubular portion of an adjacent unit 2*b*. A similar connecting element can be inserted into the tubular portions at the interface between wall units 2*b* and 2*c*. When aligned in this way, at least one of the wall faces may be planar in that the entire said wall face is flat aside from the joining interfaces between the wall units.

When multiple units are engaged with each other via one or more connecting elements, the outer wall faces of the adjoined units may form the overall wall wherein each face of the wall is continuous apart from the unit joining lines.

The wall may be free standing or may be attached to a base unit. The base unit, in use, resides on the floor, platform or other supporting area that the wall sits on and provides stability to the wall to help stop the wall falling over.

The wall may be used to support further objects. These further objects may be directly mounted on a wall outer surface, such as a poster, or may be supported by a support member extending outwardly from an outer wall face. A wall unit may have, none, one or a plurality of support members. For example, some wall units in a wall may have no support member whilst other wall units have one or more support members. The number and position of the support members of a wall unit or wall may depend on the end use of the wall. The support members are discussed in greater detail elsewhere herein.

The support member may be attached directly to the outer wall or may pass into a hole in the outer wall surface and connect to one or more of the reinforcing members internal to the body. An example of a further object that may be supported by the support members may be a frame for hanging or otherwise further supporting other objects. The frame may directly connect or hang upon the support members. Additionally, or alternatively, the support member may be coupled to a hook that in turn is used to hang the frame upon. The hook may be integrally formed with the support member, for example forming the end of the support member distal from the wall outer face. The hook may also be a separately formed object that attaches (preferably mechanically engages) with the said distal end of the support member.

The frame may be a grid frame. The grid frame may have a first set of spaced apart parallel rods that intersect and rigidly connect with a second set of parallel rods, the first set of the rods running perpendicular with the second set of parallel rods.

Figure 2B:
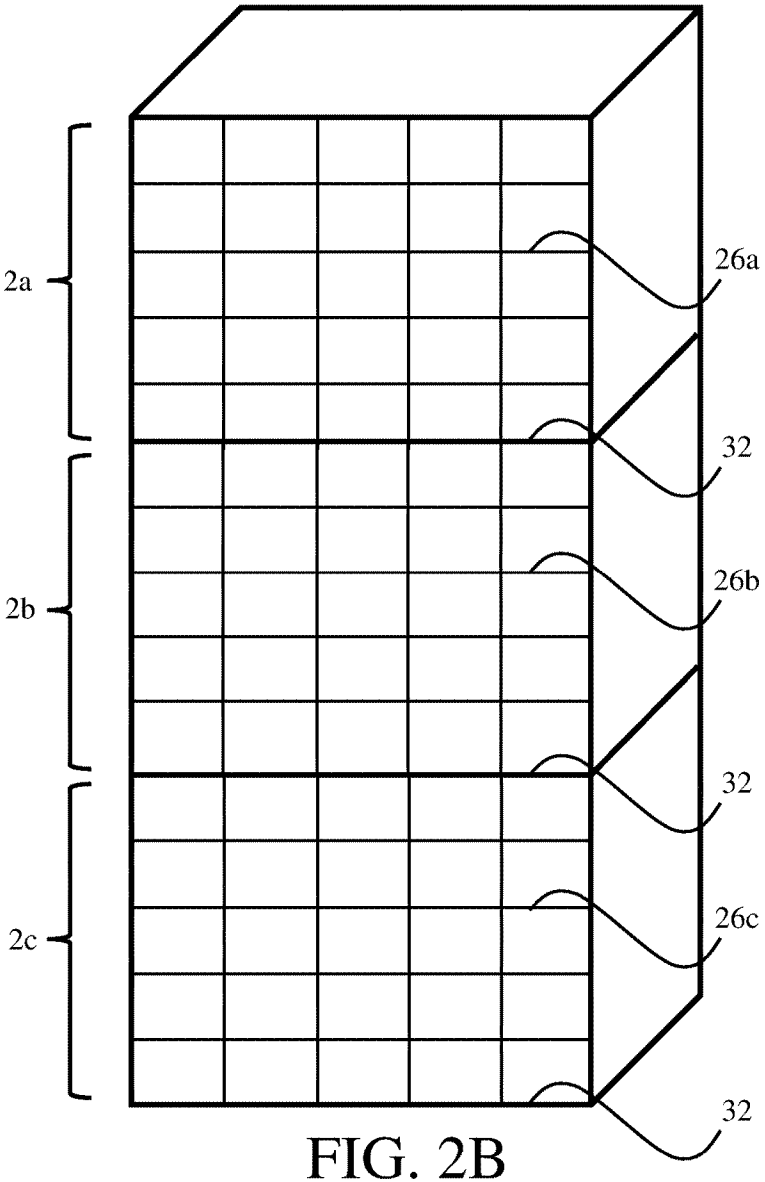
FIG. 2B is a schematic diagram showing a perspective view of a modular wall system comprising a plurality of modular wall units and a grid frame supported on each modular wall unit.
Figure 2A:
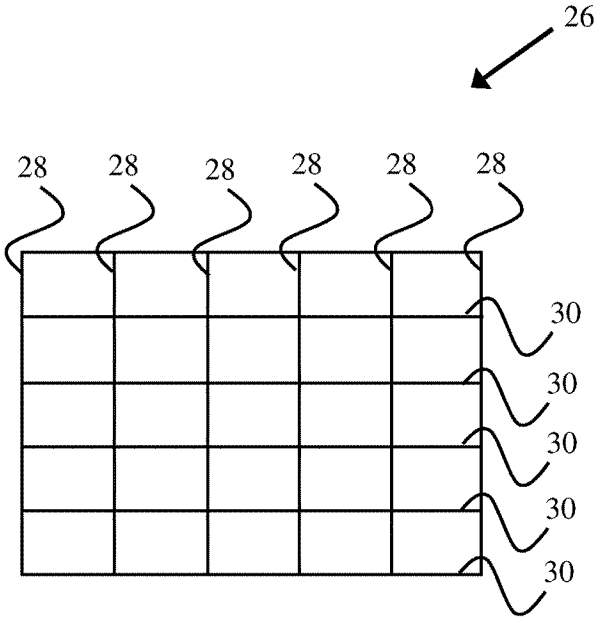
FIG. 2A is a schematic diagram showing a front view of a grid frame for use with a modular wall unit.

FIG. 2A shows an example of such a grid frame. The grid frame 26 shown in FIG. 2A has a first set of spaced apart parallel rods 28 that intersect and rigidly connect with a second set of parallel rods 30. FIG. 2B shows an example of a wall supporting frames used to attach plants or artificial plants (not shown). Other items may be supported by the support member aside from plants or artificial plants. The wall shown in FIG. 2B is a three-unit high, one-unit wide wall formed by the outer wall faces of multiple adjoined units 2*a*, 2*b*, 2*c* engaging with each other via one or more connecting elements. The connection of the units 2*a*, 2*b*, 2*c* in this example is described as follows with reference to the units comprising tubular portions (not shown) and internal reinforcement members (not shown). In this example, the lowermost unit 2*c* comprises a single tubular portion proximal to the end of the reinforcement member internal to the lowermost unit 2*c*, which faces the middle unit 2*b*. The middle unit 2*b* comprises two tubular portions, namely a tubular portion proximal to each end of the reinforcement member internal to the middle unit 2*b*. The uppermost unit 2*a* comprises a single tubular portion proximal to the end of the reinforcement member internal to the uppermost unit 2*a*, which faces the middle unit 2*b*. In this example, a first plug engages with the tubular portion of the lowermost unit 2*c* and the adjacent tubular portion of the middle unit 2*b*. The first plug thereby connects the lowermost unit 2*c* to the middle unit 2*b*. A second plug engages with the tubular portion of the uppermost unit 2*a* and the adjacent tubular portion of the middle unit 2*b*. The second plug thereby connects the uppermost unit 2*a* to the middle unit 2*b*.

The face of the wall is continuous apart from the unit joining lines 32. Frames 26*a*, 26*b* and 26*c* are supported on the wall shown in FIG. 2B. The frames 26*a*, 26*b* and 26*c* may be used to attach plants, artificial plants, or other items to the wall.

The wall unit will now be described in more detail with reference to FIG. 3 to FIG. 7C. Following this, further examples of modular wall systems are described with reference to FIGS. 8A to 11.

Figure 3:
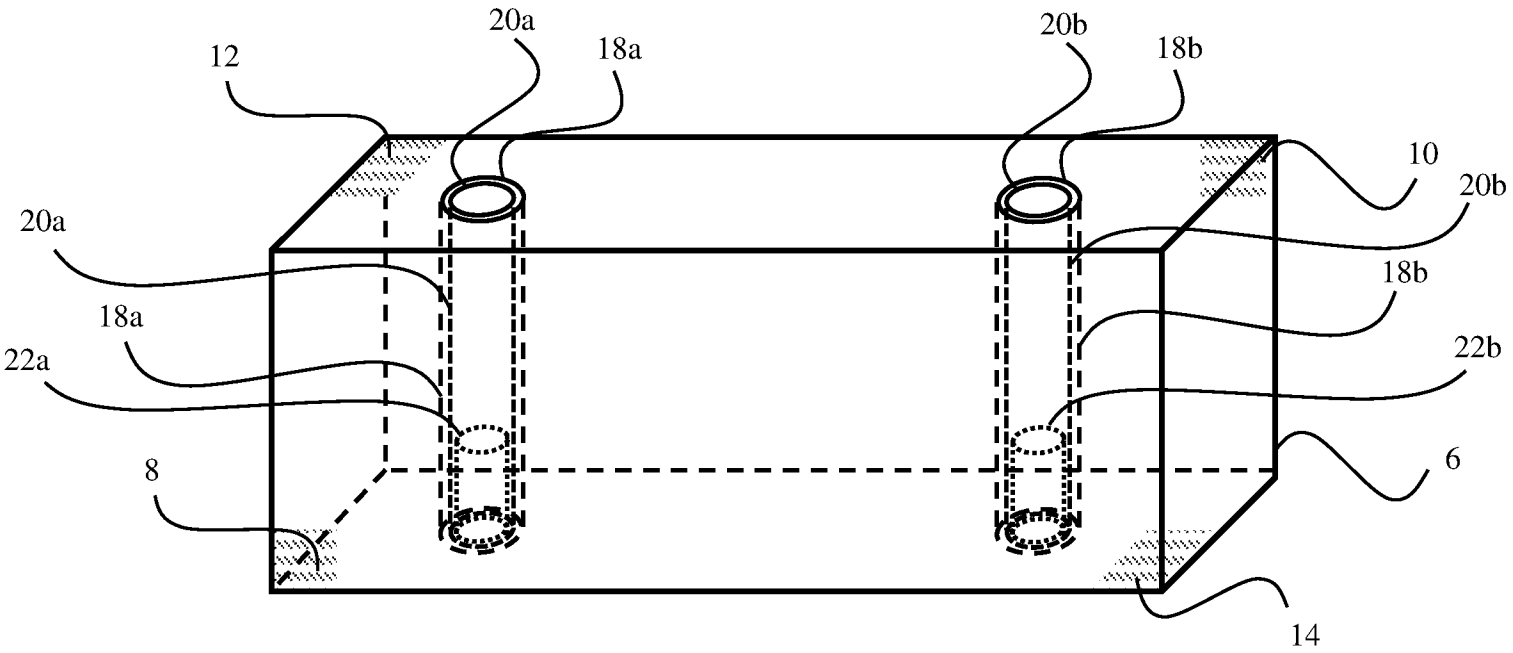
FIG. 3 is a schematic diagram showing a perspective view of a modular wall unit for a modular wall system.

FIG. 3 shows a further example of a modular wall unit for a modular wall system. The modular wall unit comprises a body 6 having first 8 and second 10 outer wall faces, first 12 and second 14 joining faces that each extend between the first 8 and second 10 outer wall faces. At least one of the first 12 and second 14 joining faces for facing a joining face of a further modular wall unit of a modular wall system. The body 6 comprises a first through-hole 18*a* and a second through-hole 18*b*, both the first through-hole 18*a* and the second through-hole 18*b* extending between the first 12 and second 14 joining faces. The body 6 further comprises a first elongate reinforcement member 20*a* and a second elongate reinforcement member 20*b*. The first elongate reinforcement member 20*a* and the second elongate reinforcement member 20*b* extend between the first joining face 12 and the second joining face 14 and within the first through-hole 18*a* and the second through-hole 18*b*, respectively.

The first elongate reinforcement member 20*a* and the second elongate reinforcement member 20*b* have tubular portions 22*a*, 22*b* proximal to terminating ends of the first elongate reinforcement member 20*a* and the second elongate reinforcement member 20*b*.

The modular wall unit shown in FIG. 3 therefore has internal reinforcement members 20*a*, 20*b* giving strength to the unit. The internal reinforcement members 20*a*, 20*b* allow for a connecting element to be inserted into each of the through-holes 18*a*, 18*b* and engage with the tubular end portion 22*a*, 22*b*, for example by an interference fit. The connecting element may be used to connect with other portions of the wall system 4, for example with further wall units or other units such as a base unit, as discussed above with reference to FIG. 1A and FIG. 1B.

H-Shaped Frame

Figure 4:
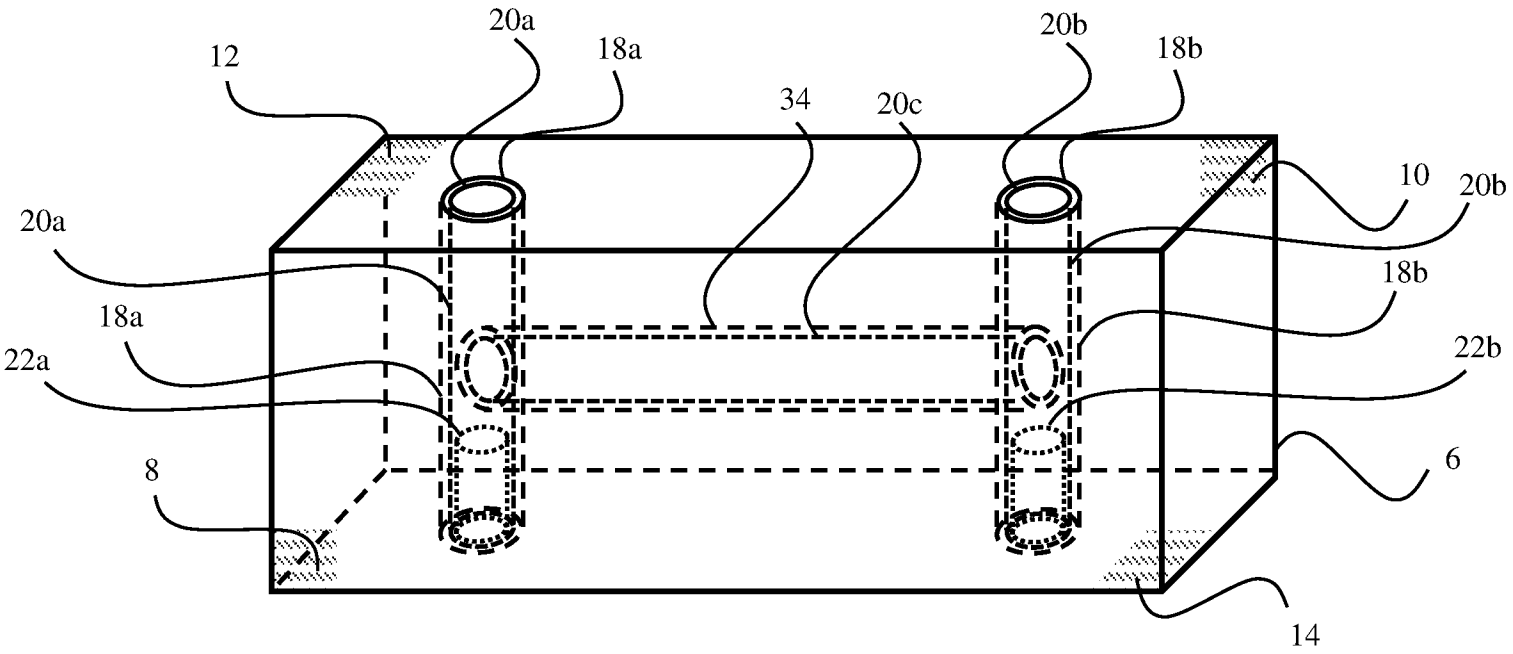
FIG. 4 is a schematic diagram showing a perspective view of a modular wall unit for a modular wall system wherein the modular wall unit comprises an H-shaped frame.

FIG. 4 shows a further example of a modular wall unit for a modular wall system, wherein the modular wall unit comprises an H-shaped frame that is described in further detail as follows. The modular wall unit comprises a body 6 having first 8 and second 10 outer wall faces, first 12 and second 14 joining faces that each extend between the first 8 and second 10 outer wall faces. At least one of the first 12 and second 14 joining faces for facing a joining face of a further modular wall unit of a modular wall system. The body 6 comprises a first through-hole 18*a* and a second through-hole 18*b*, both the first through-hole 18*a* and the second through-hole 18*b* extending between the first 12 and second 14 joining faces. The body 6 further comprises an internal recess 34 extending away from and adjoining the first through-hole 18*a*. The recess 34 may also be termed a third through-hole extending between and connecting the first and second through-holes 18*a*, 18*b*. The internal recess 34 extends at least between the first through-hole 18*a* and the second through-hole 18*b*. The body 6 further comprises a first elongate reinforcement member 20*a* and a second elongate reinforcement member 20*b*. The first elongate reinforcement member 20*a* and the second elongate reinforcement member 20*b* extend between the first joining face 12 and the second joining face 14 and within the first through-hole 18*a* and the second through-hole 18*b*, respectively.

The body 6 further comprises a third elongate reinforcement member 20*c* that resides in the internal recess 34 and is connected to the first elongate reinforcement member 20*a*. The third elongate reinforcement member 20*c*, which resides in the internal recess 34, is also connected to the second elongate reinforcement member 20*b*. The first elongate reinforcement member 20*a*, the second elongate reinforcement member 20*b*, and the third elongate reinforcement member 20*c* thereby form an H-shaped frame residing within internal recesses formed by the first through-hole 18*a*, the second through-hole 18*b* and the internal recess 34. The third elongate reinforcement member 20*c* may be connected to the first elongate reinforcement member 20*a* and the second elongate reinforcement member 20*b* by welding if the reinforcement members 20*a*, 20*b*, 20*c* are made from a metal, e.g., Aluminium. Alternatively, the first, second, and third elongate reinforcement members 20*a*, 20*b*, 20*c* may be a unitary piece. For example, the unitary piece may be molded from plastic such as acrylonitrile butadiene styrene (ABS).

The first elongate reinforcement member 20*a* and the second elongate reinforcement member 20*b* have tubular portions 22*a*, 22*b* proximal to terminating ends of the first elongate reinforcement member 20*a* and the second elongate reinforcement member 20*b*. A connecting element can be inserted into the through-holes 18*a*, 18*b* and engage with the tubular end portions 22*a*, 22*b*.

A plurality of modular wall units can be assembled by placing the lower joining face of a first modular wall unit adjacent to the upper joining face of a second modular wall unit and aligning the through-holes of the first modular wall unit with the through-holes of the second modular wall unit, such that a connecting element can be inserted into each of the through-holes. The first and second internal reinforcement members may comprise a tubular end portion at each terminating end of the reinforcement member. When a connecting element is inserted into one of the through-holes of the first modular wall unit, it engages with the corresponding tubular end portion within the internal reinforcement member of the first modular wall unit. The same connecting element can then be interested into one of the through-holes of the second modular wall unit, thereby engaging with the corresponding tubular end portion within the internal reinforcement member of the second modular wall unit.

Advantageously, the connecting elements provide structural support to the modular wall system formed by the assembly of multiple modular wall units whilst enabling the modular wall system to be assembled in a modular fashion, one modular wall unit at a time. In contrast to prior art systems, the modular wall units need not be assembled into a column before being connected by a connecting element. In addition, the connecting element is not required to run all the way through the through-hole of the modular wall unit. The modular wall therefore requires less material to form the connecting elements required for assembling the modular wall system. Furthermore, the connecting elements can engage with the tubular end portions by an interference fit and do not require any bolts or screws.

The modular wall unit further provides not only vertical structural support, but also horizontal structural support by way of the H-shaped frame residing within internal recesses formed by the first through-hole 18*a*, the second through-hole 18*b* and the internal recess 34. The provision of an H-shaped frame within each modular wall unit provides structural support to the unit itself as well a modular wall system formed from a plurality of modular wall units. The internal reinforcement members 20*a*, 20*b*, 20*c*, which form the H-shaped frame of the modular wall unit shown in FIG. 4, provide further strength to the modular wall unit in that the first and second elongate reinforcement members 20*a*, 20*b* are supported and held in place by the third elongate reinforcement member 20*c*. This provides a significant advantage over a modular wall unit having only the first and second elongate reinforcement members 20*a*, 20*b*, and lacking the third elongate reinforcement member 20*c*, as the structural support provided by the third elongate reinforcement member 20*c* prevents the first and second elongate reinforcement members 20*a*, 20*b* from bending. This is particularly important for the assembled modular wall system as it enables a more stable wall structure to be assembled that is less prone to toppling. Furthermore, the H-shaped frame enables an improved torsional strength in comparison to several unconnected poles or reinforcement members. In addition, the more stable wall structure enables objects to be mounted on the wall with ease and stability.

Furthermore, the H-shaped frame, in comparison to several unconnected poles or reinforcement members, enables the modular wall unit to be manufactured more efficiently. The body portion of the modular wall unit may be unitary in structure and surround the reinforcement members. For example, the body portion may comprise a foam material and be prepared using insert molding techniques. Advantageously, inserting the unitary H-shaped frame into a mold is faster and easier in comparison to inserting several unconnected elements into a mold. In addition, the relative position of the reinforcement members and the outer holes of the reinforcement members are fixed, which enables the modular wall system to be assembled more efficiently and with ease.

Figure 5B:
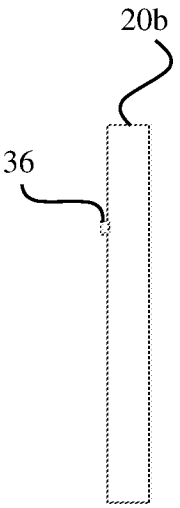
FIG. 5B is a schematic diagram showing a side view of an H-shaped frame for a modular wall unit.
Figure 5A:
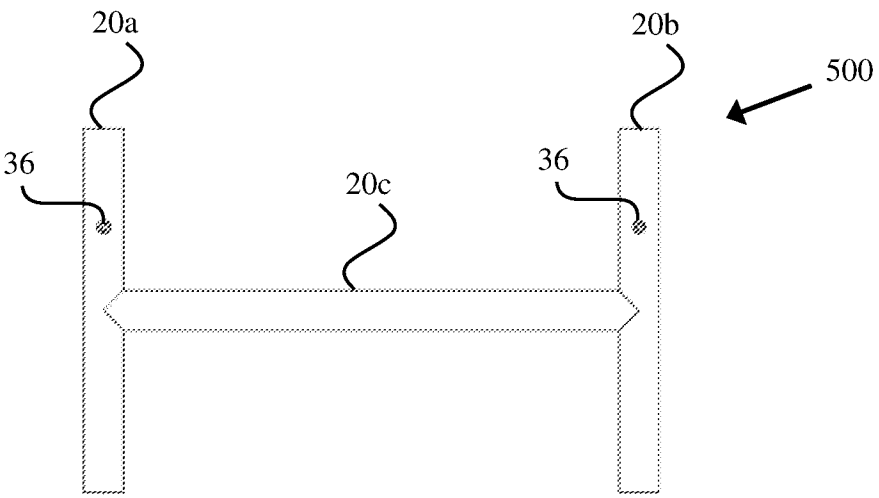
FIG. 5A is a schematic diagram showing a front view of an H-shaped frame for a modular wall unit.
Figure 5C:
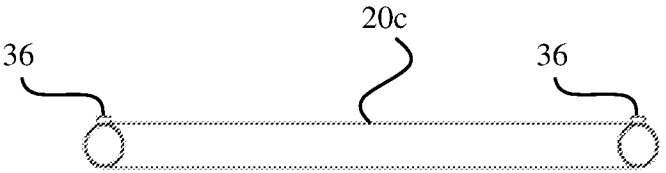
FIG. 5C is a schematic diagram showing a plan view of an H-shaped frame for a modular wall unit.

FIGS. 5A to 5C show an H-shaped frame independent of a modular wall unit. The H-shaped frame has a first elongate reinforcement member 20*a* and a second elongate reinforcement member 20*b* configured to be in parallel to one another and spaced apart by a distance. The first elongate reinforcement member 20*a* and the second elongate reinforcement member 20*b* may each have a length of between 200-800 millimetres and a diameter of between 20-60 millimetres. Preferably, the first elongate reinforcement member 20*a* and the second elongate reinforcement member 20*b* may each have a length of between 300-500 millimetres and a diameter of between 40-50 millimetres. The first elongate reinforcement member 20*a* and the second elongate reinforcement member 20*b* may each have a length of about 407 millimetres and a diameter of about 44.5 millimetres.

A third elongate reinforcement member 20*c* resides between the first and second elongate reinforcement members 20*a*, 20*b*. The third elongate reinforcement member 20*c* is connected to the first elongate reinforcement member 20*a* at approximately halfway between the ends of the first elongate reinforcement member 20*a*. The third elongate reinforcement member 20*c* may have a length of about 300-900 millimetres and a diameter of about 20-60 millimetres. Preferably, the third elongate reinforcement member 20*c* may each have a length of between 500-700 millimetres and a diameter of between 40-50 millimetres. The third elongate reinforcement member 20*c* may have a length of about 600 millimetres and a diameter of about 44.5 millimetres.

Similarly, the third elongate reinforcement member 20*c* is connected to the second elongate reinforcement member 20*b* at approximately halfway between the ends of the second elongate reinforcement member 20*b*. The H-shaped frame 500 further comprises a fixing mechanism 36 located on each of the first and second elongate reinforcement members 20*a*, 20*b* for securing the H-shaped frame within a modular wall unit. Although an H-shaped frame is preferable, the third elongate reinforcement member may be connected to the first elongate reinforcement member at other positions along the length of the first elongate reinforcement member and the second elongate reinforcement member.

Figure 6A:
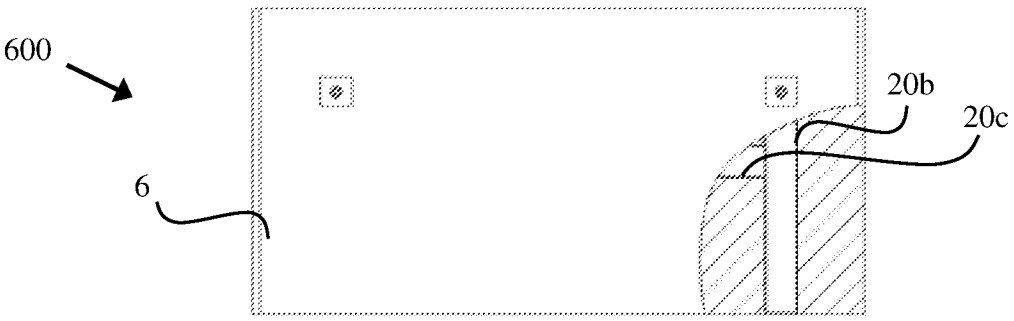
FIG. 6A is a schematic diagram showing a front and partially cut away view of a modular wall unit comprising an H-shaped frame.
Figure 6B:
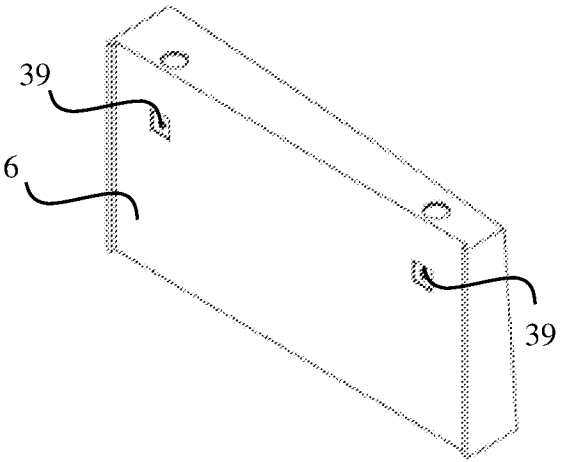
FIG. 6B is a schematic diagram showing a front perspective view of the modular wall unit shown in FIG. 6A.
Figure 6C:
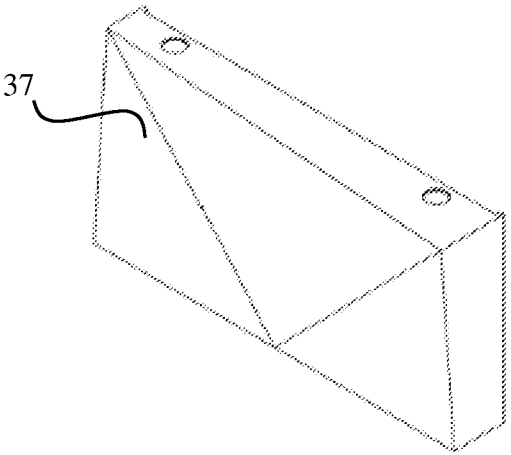
FIG. 6C is a schematic diagram showing a rear perspective view of the modular wall unit shown in FIG. 6A and FIG. 6B.

FIGS. 6A to 6C show a modular wall unit 600 comprising the internal H-shaped frame described above with reference to FIGS. 5A to 5C. The second elongate reinforcement member 20*b* and the third elongate reinforcement member 20*c* can be seen in the cutaway portion of the modular wall unit 600 shown in FIG. 6A. The front of the modular wall unit 600, which forms the wall, is shown in FIG. 6B.

The wall formed using the modular wall unit 600 may be used to support further objects that may be supported by a support member extending outwardly from an outer wall face. The modular wall unit 600 has two support members 39. Each support member passes into a hole in the outer wall surface and connects to one or more of the reinforcing members internal to the body. The support members connect to one or more of the reinforcing members forming the H-shaped frame 500 via the fixing mechanism 36 (shown in FIG. 5A).

This fixing mechanism in this example is a screw hole configured to receive a complementary threaded end of the support member. The support members may be attached in other ways including, but not limited to, being welded or attached via an adhesive, e.g., glue. The support members are discussed in greater detail below with reference to FIGS. 12A-12D. The rear of the modular wall unit 600 is provided with a three-dimensional pattern 37 that is appealing to the eye for display in rooms such as offices.

Connecting Element

Figure 7A:
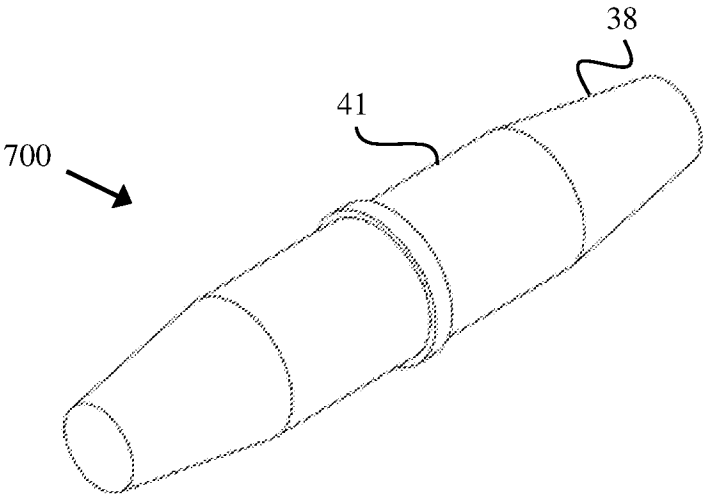
FIG. 7A is a schematic diagram showing a perspective view of a connecting element.
Figure 7C:
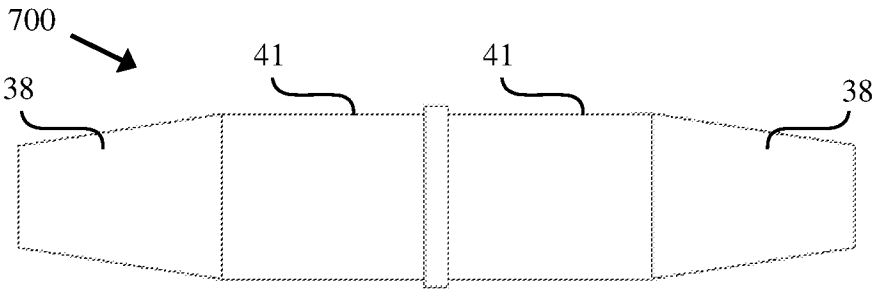
FIG. 7C is a schematic diagram showing a front view of the connecting element shown in FIG. 7A.
Figure 7B:
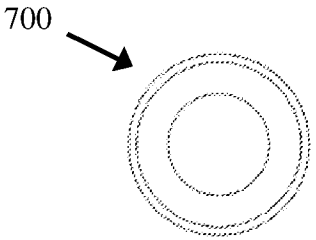
FIG. 7B is a schematic diagram showing a side view of the connecting element shown in FIG. 7A.

FIGS. 7A to 7C show a connecting element 700 that can be inserted into the through-hole 18*a*, 18*b*. Connecting elements may be used to engage multiple units with each other.

The connecting element 700 may be used to connect with further wall units or other units such as a base unit. The connecting element 700 shown in FIGS. 7A to 7C is in the form of a connecting plug. The connecting element may be another suitable means such as a connecting pin. The connecting element 700 may be made from plastic, for example ABS. The connecting element 700 has a cylindrical portion 41, which is sized in accordance with the tubular portion of the reinforcement member. For example, the outer diameter of the cylindrical portion 41 of the connecting element 700, may be substantially similar to or the same as the internal diameter of the tubular portion of the reinforcement member. This enables the connecting element 700 to engage with the tubular portion of the reinforcement member by way of an interference fit. Advantageously, the connecting element holds the reinforcement members of adjacent units in place with the interference fit, whilst allowing the reinforcement members to be dissembled at a faster rate when required. The connecting element 700 has tapered ends 38. The tapered ends 38 make it easier for a user system to locate and/or insert the connecting element 700 into the reinforcement member.

Further examples of modular wall systems will now be described with reference to FIGS. 8A to 11.

Figure 8A:
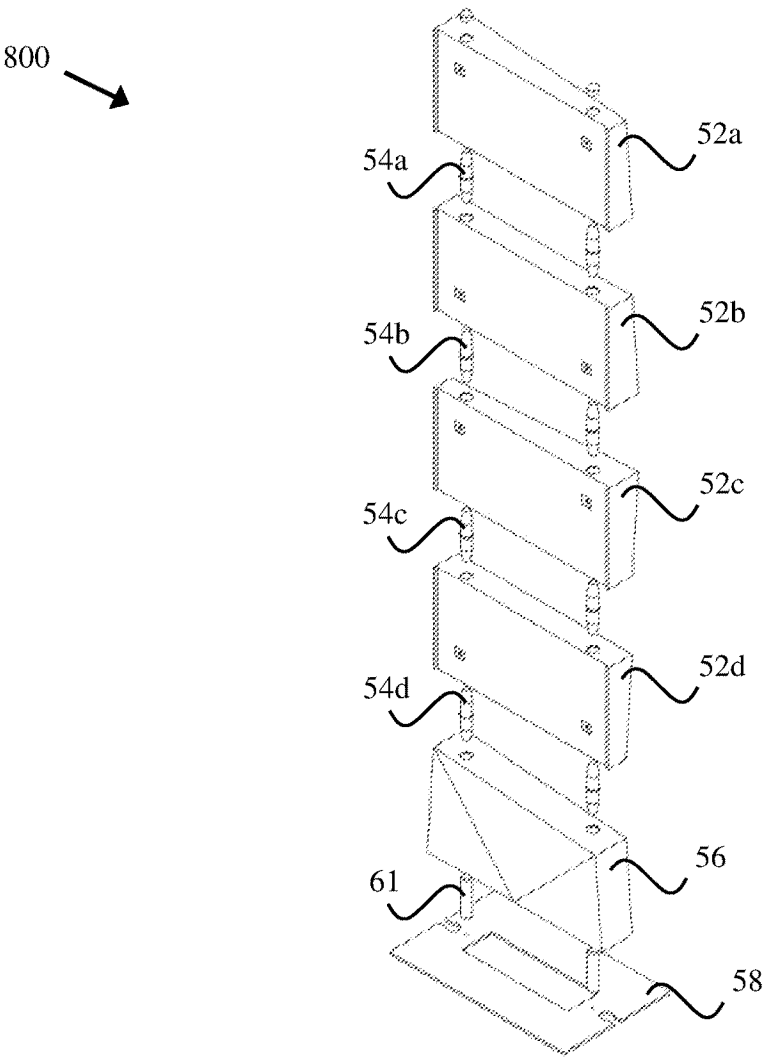
FIG. 8A is a schematic diagram showing an exploded perspective view of a modular wall system comprising a plurality of modular wall units stacked on top of each other and connected together by connecting elements to form a four unit high, one unit wide wall that is connected to a further unit and a base unit for stabilizing the wall.

FIG. 8A shows a modular wall system 800 comprising a plurality of modular wall units 52*a*-52*d* stacked on top of each other and connected together by connecting elements 54*a*-54*d* to form a four-unit high, one-unit wide wall. The connecting elements 54*a*-54*d* are substantially similar to the connecting element described above with respect to FIGS. 7A to 7C. The lowermost modular wall unit 52*d* is connected to a further unit 56 wherein the purpose of the further unit 56 is to stabilize the wall formed by the stacked modular wall units 52*a*-52*d* and to enable connection of the stacked modular wall units 52*a*-52*d* to a base unit 58. The base unit 58 is rectangular in shape with a surface area that is larger than the surface area of the modular wall unit facing the base unit 58. Advantageously, this enables the base unit 58 to provide stability to the stacked modular wall units 52*a*-52*d*. The further unit 56 is connected to the base unit 58 using a connecting element 61. The connecting element 61 shown in FIG. 8A is cylindrical in shape, but the connecting element may be sized and shaped suitably to fulfil its purpose of connecting the base unit 58 to the further unit 56. For example, the connecting element used to connect the further unit 56 to the base unit 58 may be similar in size and shape to the connecting element discussed above with reference to FIGS. 7A-7C. Alternatively, the base unit 58 may connect directly to the lowermost modular wall unit 52*d*, without requiring a connecting element.

Figure 8C:
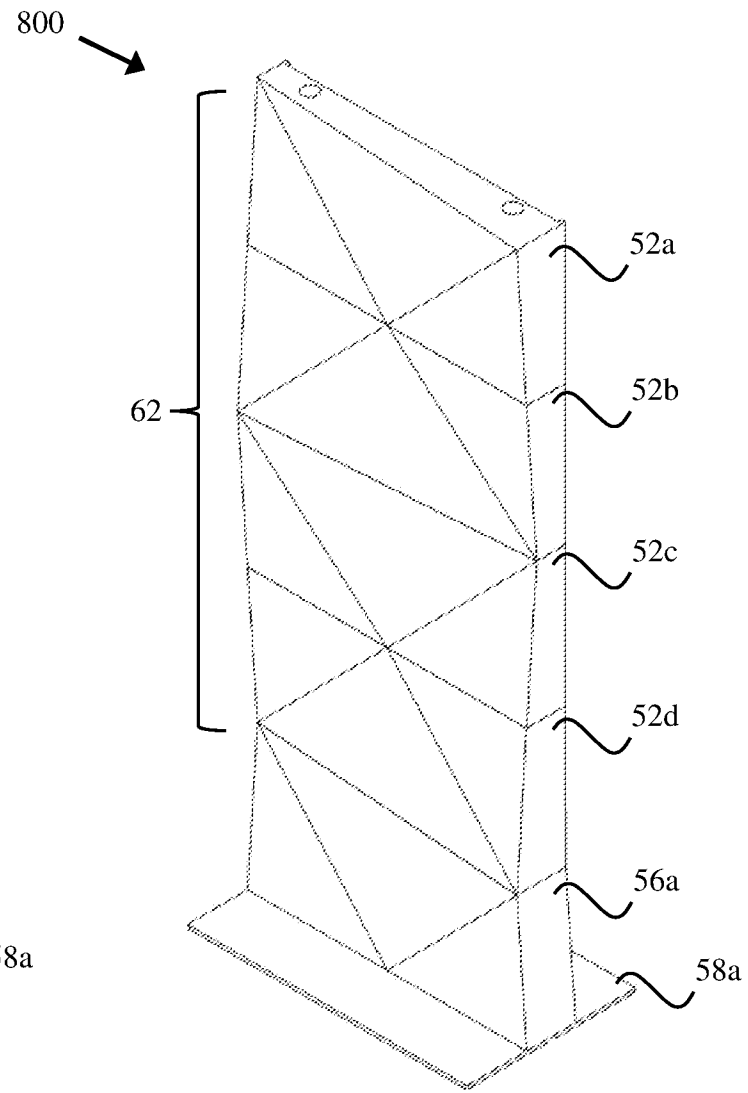
FIG. 8C is a schematic diagram showing a rear perspective view of the modular wall system shown in FIG. 8A.
Figure 8B:
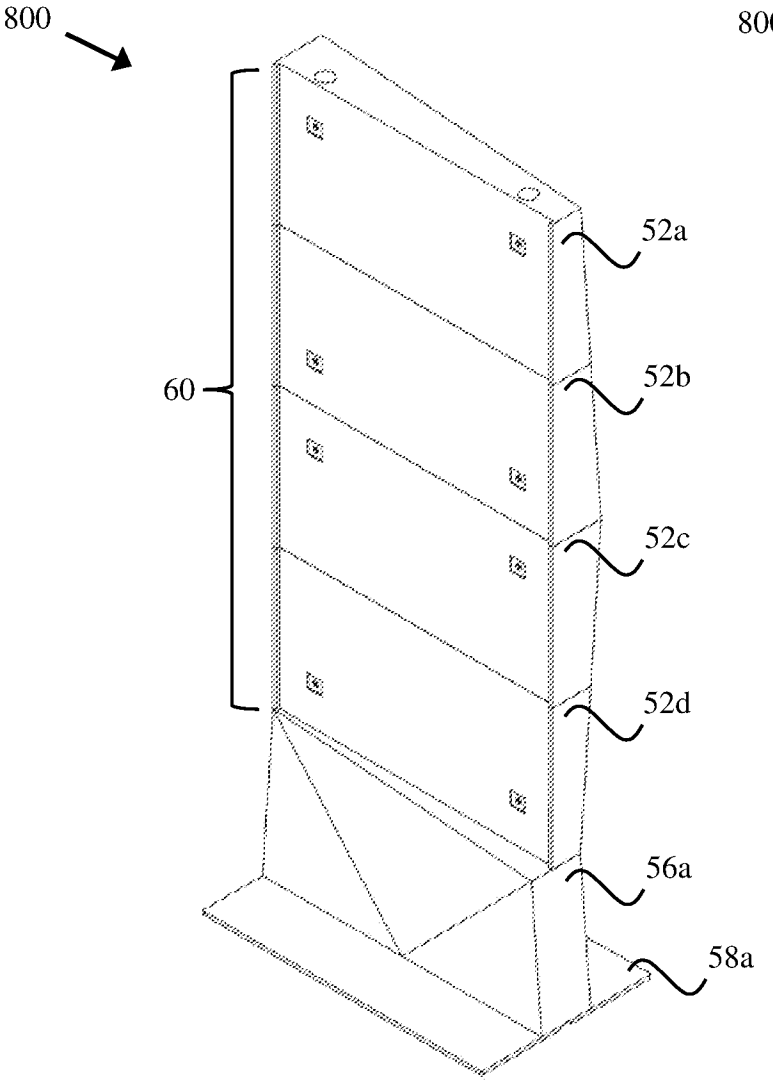
FIG. 8B is a schematic diagram showing a front perspective view of the modular wall system shown in FIG. 8A.

FIG. 8B and FIG. 8C show front and rear views of the modular wall system 800. The modular wall system 800 has a plurality of modular wall units 52*a*-52*d* wherein the system forms a wall 60. The wall 60 is stabilized by the further unit 56 and the base unit 58. The rear of the modular wall system 800 is provided with a three-dimensional pattern 62 that is appealing to the eye for display in rooms such as offices.

Figure 9B:
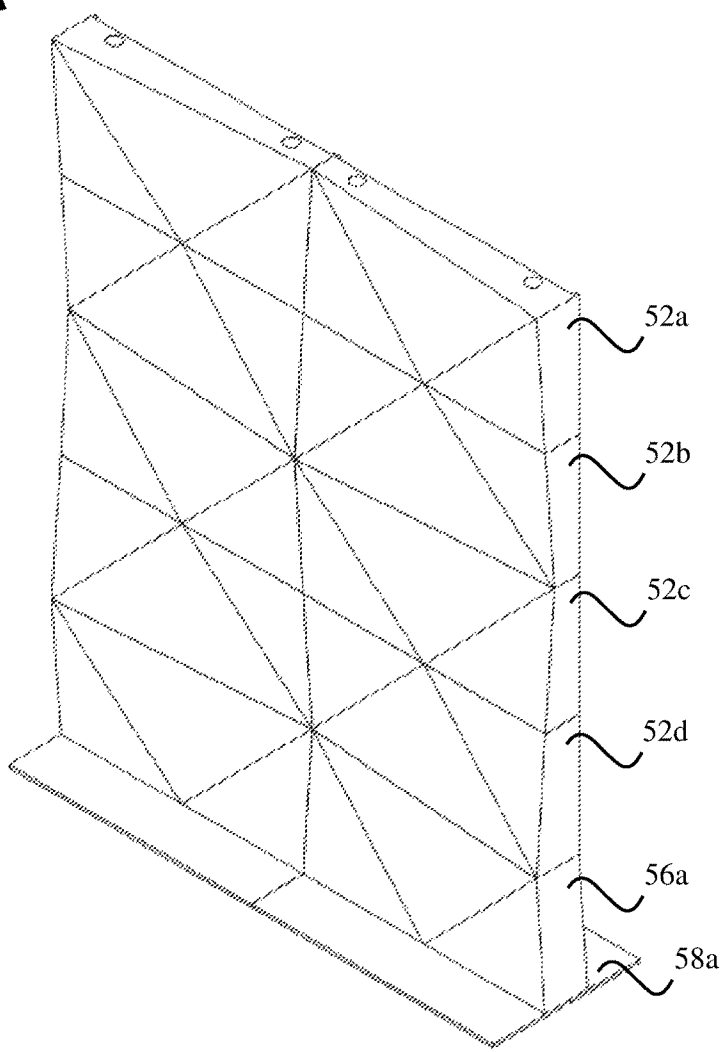
FIG. 9B is a schematic diagram showing a rear perspective view of the modular wall system shown in FIG. 9A.
Figure 9A:
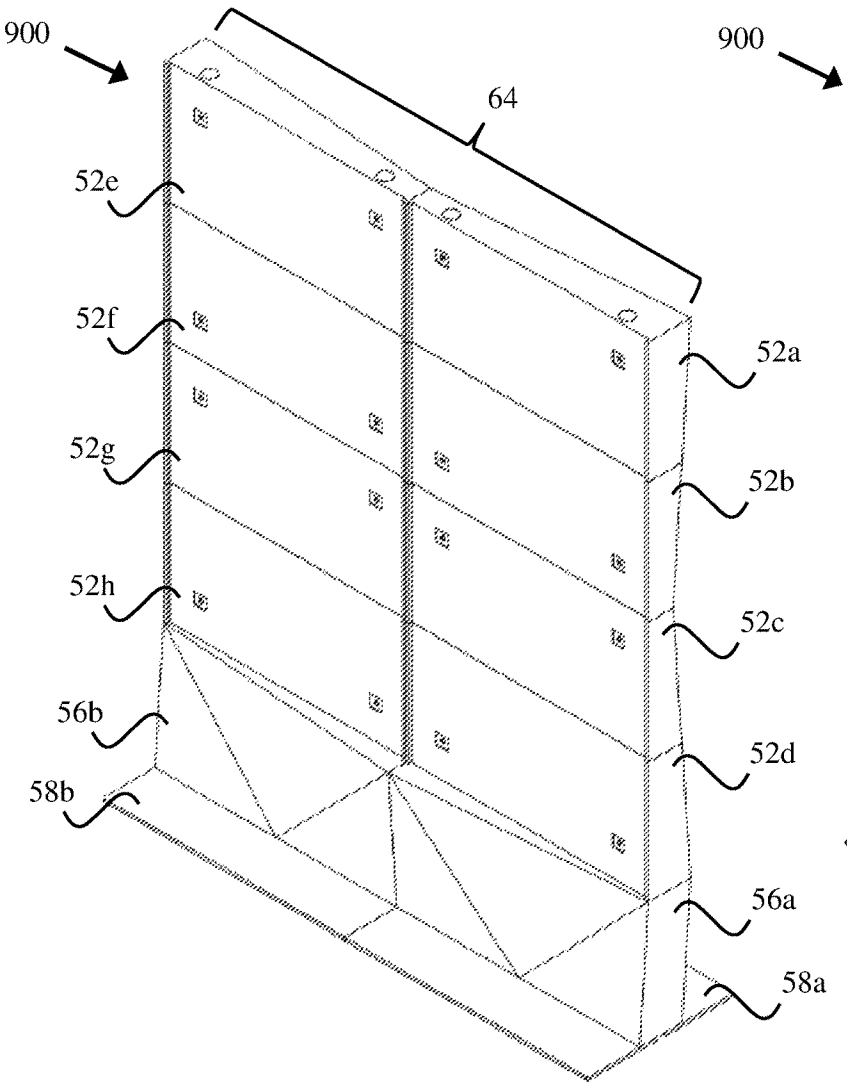
FIG. 9A is a schematic diagram showing a front perspective view of a modular wall system comprising a plurality of modular wall units stacked on top of each other and connected together by connecting elements to form a four-unit high, two-unit wide wall that is connected to two further units and two base units for stabilizing the wall.

FIG. 9A and FIG. 9B show front and rear views of a modular wall system 900 comprising a plurality of modular wall units 52*a*-52*h*. The modular wall system 900 forms a four-unit high, two-unit wide wall. Four modular wall units 52*a*-52*d* are stacked on top of each other and connected to a further set of four modular wall units 52*e*-52*h* that are stacked on top of each other, to form the four-unit high, two-unit wide wall. The lowermost modular wall units 52*d*, 52*h* are connected to further units 56*a*, 56*b* wherein the purpose of the further units 56*a*, 56*b* is to stabilize the wall formed by the stacked modular wall units 52*a*-52*h* and to enable connection of the stacked modular wall units 52*a*-52*h* to base units 58*a*, 58*b*. The further units 56*a*, 56*b* may take the form of a modular wall unit as described herein. In the example shown in FIGS. 9A and 9B, the further units 56*a*, 56*b* further comprise a three-dimensional pattern that is appealing to the eye for display in rooms such as offices. As such, the further units 56*a*, 56*b* provide the three-dimensional pattern at the outer surface of the further units, in contrast to the wall as provided by the modular wall units 52*d*, 52*h*.

The base units 58*a*, 58*b* are rectangular in shape with a total surface area that is larger than the total surface area of the modular wall units facing the base units 58*a*, 58*b*. Alternatively, the base unit may be made of a single unit with a size corresponding to the total surface area of the modular wall units facing the base unit.

Figure 10:
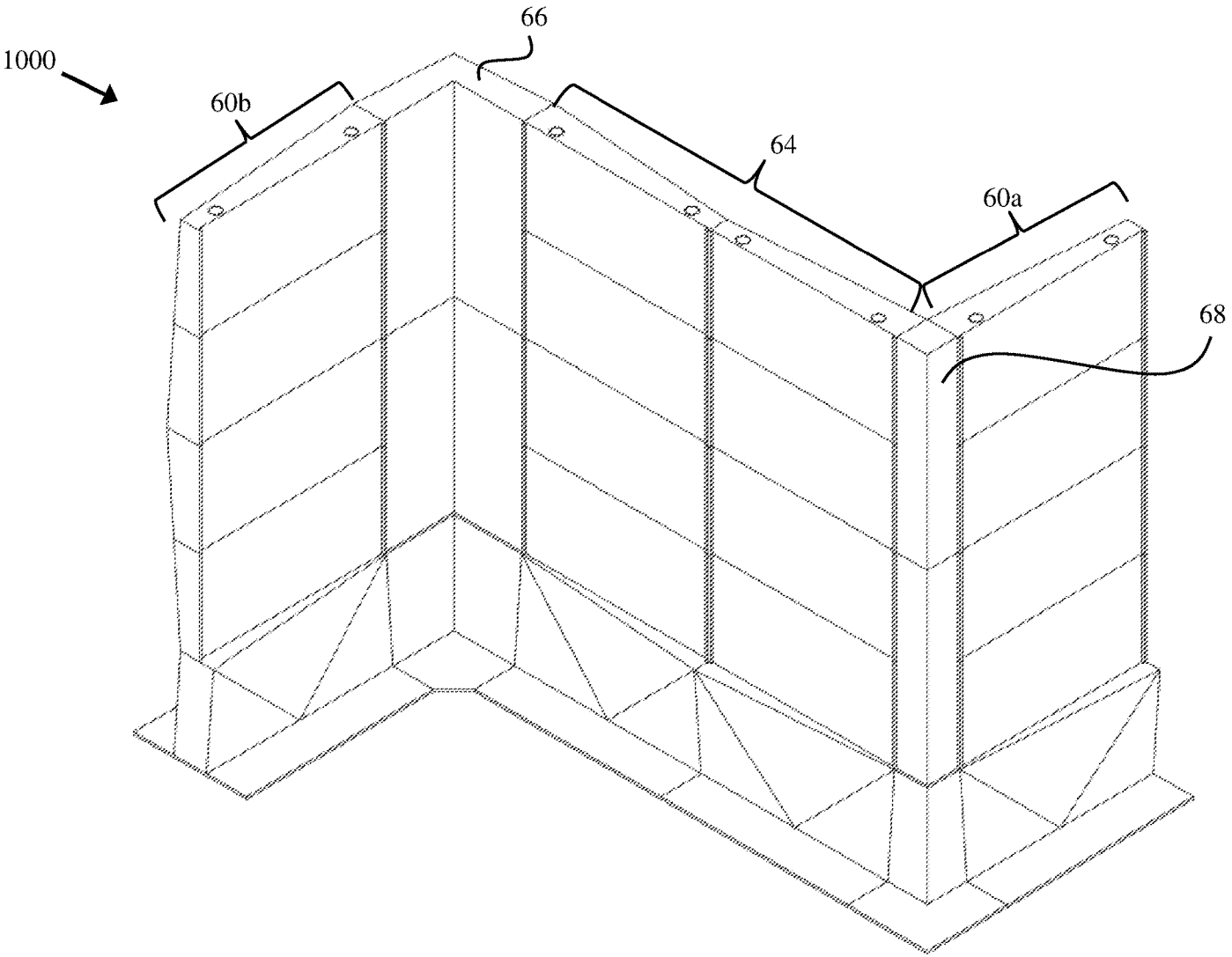
FIG. 10 is a schematic diagram showing a perspective view of a modular wall system comprising two corner units for connecting three walls at a 90-degree angle to one another.

FIG. 10 shows a modular wall system 1000 comprising corner units 66, 68 for connecting walls at a 90-degree angle. The modular wall system 1000 has a four-unit high, two-unit wide wall 64 located at a central part of the modular wall system 1000. The wall 64 is sandwiched between two corner units 66, 68. The corner units may be configured to connect the wall 64 to further walls 60*a*, 60*b* such that the central wall 64 and the further walls 60*a*, 60*b* are positioned at a 90-degree angle with respect to each other. A corner unit 66 may be formed of two portions extending along the length of the wall 64, the two portions being fixed perpendicularly to one another. Placement of the corner unit 66 between the wall 64 and further wall 60*b* enables the wall 64 and the further wall 60*b* to be connected at a 90-degree angle. The further wall 60*a*, 60*b* may be connected to the wall 64 such that the further wall extends in a direction behind the wall 64 at a 90-degree angle or in a direction in front of the wall 64 at a 90-degree angle. In the example shown in FIG. 10, the corner unit 68 provides connection for a wall 60*a* extending behind the central wall 64. Similarly, the corner unit 66 provides connection for a wall 60*b* extending in front of the central wall 64. It should be noted that the terminology 'in front' and 'behind' is simply used here to illustrate the example from the viewpoint shown in FIG. 10. A first further wall 60*a* may extend from the main wall 64 in a direction opposite to the direction of a second further wall 60*b* extending from the main wall 64, such that the modular wall system 1000 forms a Z-shape or pseudo Z-shape. Alternatively, a first further wall 60*a* may extend from the main wall 64 in the same direction as the direction in which the second further wall 60*b* extends from the main wall 64, such that the modular wall system 1000 forms a U-shape.

Figure 11:
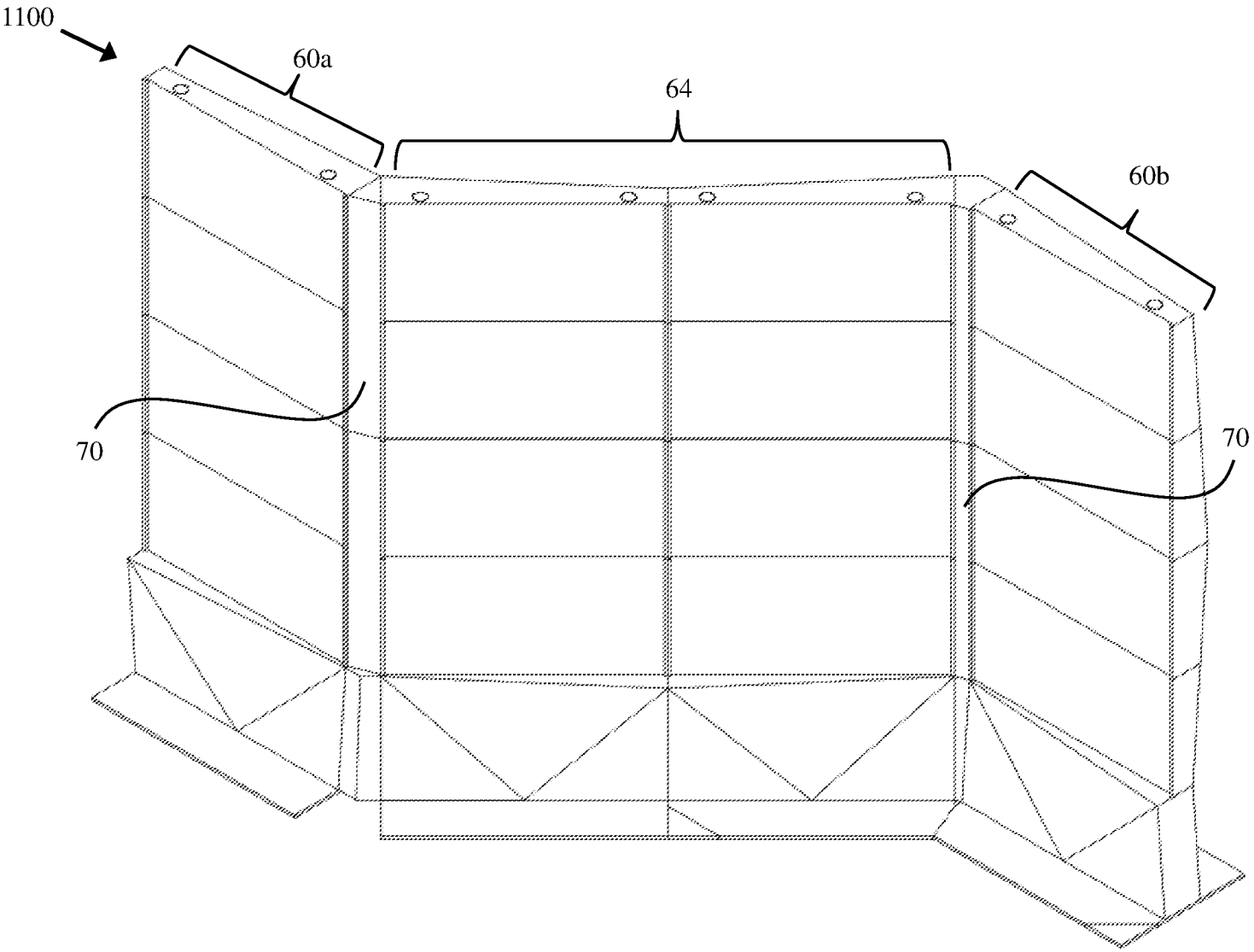
FIG. 11 is a schematic diagram showing a perspective view of a modular wall system comprising two corner units for connecting three walls at a 45-degree angle to one another.

FIG. 11 shows a modular wall system 1100 comprising corner units 70 for connecting walls at a 45-degree angle. The modular wall system 1100 has a four-unit high, two-unit wide wall 64 located at a central part of the modular wall system 1100. The wall 64 is sandwiched between two corner units 70. The corner units may be configured to connect the wall 64 to further walls 60*a*, 60*b* such that the central wall 64 and the further wall 60*a*, 60*b* are positioned at a 45-degree angle with respect to each other. A corner unit 70 may be formed of two portions extending along the length of the wall 64, the two portions being fixed in a non-parallel position with respect to one another. Placement of the corner unit 70 between the wall 64 and further walls 60*a*, 60*b* enables the wall 64 and the further wall 60*a*, 60*b* to be connected at a 45-degree angle. The corner units may be adapted to connect walls at angles smaller or greater than 45 degrees, e.g., walls may be connected at angles of 10 degrees or 20 degrees to form a subtle curve in the modular wall system 1100, or at angles of 120 degrees to form more substantive bends in the modular wall system 1100. The versatility of such modular wall systems enables them to be adapted to suit different environments and spaces.

Body Material and Formation

The body 6 or body portion of the modular wall unit 2 may be formed of any material. The body 6 preferably comprises a rigid material. The body portion may comprise a foam material, e.g., polyurethane foam. The body portion may comprise steel, timber, other sheet materials, stone and/or concrete. The part of the body portion surrounding the reinforcement members may be unitary. The body portion may therefore be unitary in its structure and may be manufactured using insert molding techniques. Polyurethane foam material comprised in the body portion is formed by reacting a polyol (an alcohol with more than two reactive hydroxyl groups per molecule) with a diisocyanate or a polymeric isocyanate in the presence of suitable catalysts and additives. In an example of manufacturing the modular wall unit, the H-shaped frame is surrounded by a mold that holds the H-shaped frame in a specific position. The foam material is then poured into the mold. The foam material then self-expands to fill all voids within the mold, to form the body portion of the modular wall unit whereby the body portion surrounds the H-shaped frame. Alternatively, the body may be formed from multiple parts that are attached to each other.

Where the body portion comprises a foam material, the foam material may be a polymeric foam such as but not limited to any one or more of: Ethylene-vinyl acetate (EVA) foam, polyethylene-vinyl acetate (PEVA), Low-density polyethylene (LDPE) foam, first grade of polyethylene (PE), Nitrile rubber (NBR) foam, the copolymers of acrylonitrile (ACN) and butadiene, Polychloroprene foam or Neoprene, Polyimide foam, Polypropylene (PP) foam, expanded polypropylene (EPP), polypropylene paper (PPP), Polystyrene (PS) foam, expanded polystyrene (EPS), extruded polystyrene foam (XPS), polystyrene paper (PSP), Styrofoam, extruded polystyrene foam (XPS) expanded polystyrene (EPS), Polyurethane (PU) foam, LRPu low-resilience polyurethane, Memory foam, Sorbothane, Polyethylene foam, Polyvinyl chloride (PVC) foam, closed-cell PVC foamboard, Silicone foam, or Microcellular foam. Typically, PU foam is comprised within the body portion due to the lightweight nature of PU. PE may be preferable in some instances due to its strength and low water absorption. Some examples may comprise two or more polymeric foam materials mixed into the same body portion.

The shape of the body may be any suitable shape. The body shape may be substantially box-like. One of the outer wall faces may have a single planar face whilst the opposing outer wall face may have a generally overall rectangular shape but have several surfaces joined at apex lines.

Tubes

The elongate reinforcement members, e.g., the first elongate reinforcement member 20*a* and the second elongate reinforcement member 20*b*, comprised within the body 6 may be formed of any suitable material. Any of the elongate reinforcement members may comprise a metal, for example Aluminium. Any of the elongate reinforcement members may comprise a plastic, for example ABS plastic. In the examples discussed above with reference to FIG. 3 and FIG. 4, the first elongate reinforcement member 20*a* and the second elongate reinforcement member 20*b* have tubular portions 22*a*, 22*b* proximal to a terminating end of the first elongate reinforcement member 20*a* and a terminating end of the second elongate reinforcement member 20*b*. Any one or more of the elongate reinforcement members may comprise a tubular portion proximal at both terminating ends. In the examples shown in FIG. 4, for example, only the first elongate reinforcement member 20*a* may comprise a tubular portion proximal to a terminating end of the first elongate reinforcement member 20*a*. In the alternative, the first elongate reinforcement member and the second elongate reinforcement member may have tubular portions proximal to both terminating ends of each of the first elongate reinforcement member and the second elongate reinforcement member. Preferably at least the first and second reinforcement members comprise tubular end portions.

In alternative configurations, any one or more of the elongate reinforcement members may comprise a tube running the entire length of the respective reinforcement member. In one example, the reinforcement members running between the joining faces are tubes. In the examples given above with two spaced apart reinforcement members running between the joining faces and another one running between these two spaced apart members, the first and third reinforcement members are tubes. The second reinforcement member may also be a tube.

The elongate reinforcement members, particularly the ones interfacing the one or more faces of the body that are for facing an adjacent wall unit, may have a male end connector for engaging with the tubular portion of another wall unit. The connector may be one as described above and shown in FIG. 7 but may also be a connector that is at least partially integrally formed with the elongate reinforcement member. Such a connector portion of the member may protrude proud of the body.

Support Members

As described above, the wall unit may further comprise one or more support members extending outwardly from an outer wall face. The one or more support members may be used to support further objects, such as a frame for hanging or otherwise further supporting other objects.

FIGS. 12A to 12D show an example where two support members—named first support member 76 and second support member 78 herein—extend outwardly from an outer wall face. The first support member 76 passes into a hole in the outer wall surface (not shown) and connects to one or more of the reinforcing members internal to the body.

Figure 12B:
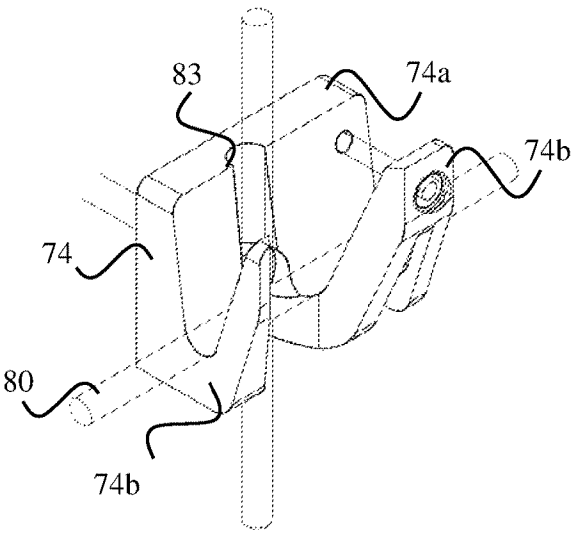
FIG. 12B is a schematic diagram showing a perspective view of the exemplary support member shown in FIG. 12A.
Figure 12D:
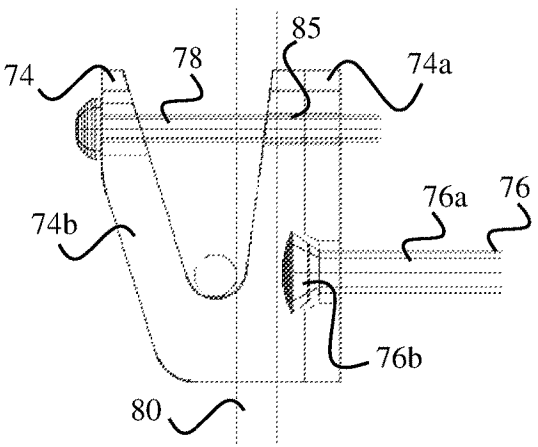
FIG. 12D is a schematic diagram showing a side view of the exemplary support member shown in FIG. 12A.
Figure 12A:
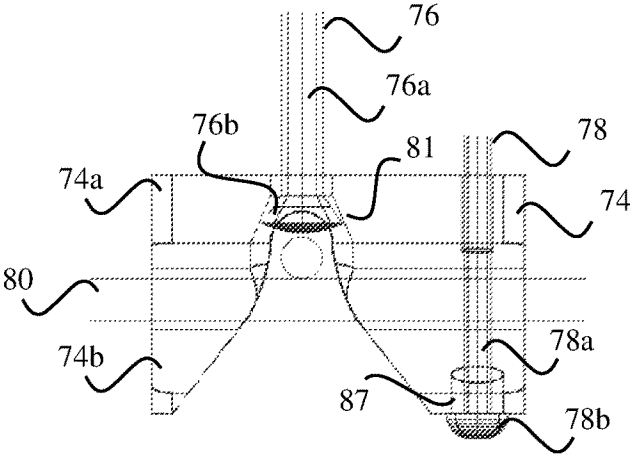
FIG. 12A is a schematic diagram showing a plan view of an exemplary support member.
Figure 12C:
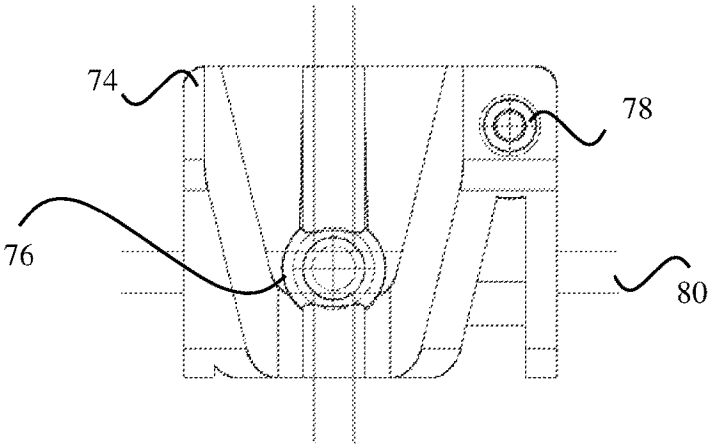
FIG. 12C is a schematic diagram showing a front view of the exemplary support member shown in FIG. 12A.

The support members 76, 78 shown in FIGS. 12A to 12D are coupled to a hook 74. The hook may also be referred to as a hanging device and is described in more detail elsewhere herein. The hook 74 is formed separately from the support members 76, 78 and mechanically engages with the support members 76, 78. The hook 74 comprises a wall portion 74*a* and a two hook portions 74*b*. The first support member 76 is mechanically engaged with the hook 74 via the wall portion 74*a*, whereas the second support member 78 is mechanically engaged with the hook 74 via both the wall portion 74*a* and one of the hook portions 74*b*, as can be seen in FIGS. 12A and 12D. The second support member 78 thereby acts as a securing pin to prevent objects from being removed from the hook.

The support members 76, 78 comprise an elongate portion 76*a*, 78*a* and a head portion 76*b*, 78*b* terminating each support member 76, 78 at a distal end away from the modular wall unit. The elongate portions 76*a*, 78*a* have a smaller maximum diameter than the maximum diameter of the respective head portions 76*b*, 78*b*.

In this example, the order in which the support members 76, 78 are engaged with the hook 74 is important in securing an object to the wall unit. The first support member 76 is passed through a hole in the wall portion 74*a* of the hook and into a hole in the outer wall surface (not shown) to connect to one or more of the reinforcing members internal to the body. The first support member 76 thereby initially secures the hook 74 to the outer wall surface and in turn the one or more of the reinforcing members. A frame 80 can be hung upon the hook 74. An example of such a frame is discussed above with reference to FIG. 2A and FIG. 2B. The second support member 78 is then passed through a hole in the hook portion 74*b* and then through a hole in the wall portion 74*a* of the hook, to secure the object within the hook and prevent it from being removed. The second support member 78 is subsequently passed into a hole in the outer wall surface (not shown). Alternatively, the second support member 78 may not be connected to the outer wall surface, the securing functionality being provided by connected the second support member 78 to the wall portion of the hook only. The present arrangement enables the frame 80 to be held securely in place, whilst preventing removal by, for instance, theft.

A plurality of hooks 74 may be attached to the outer wall surface of the wall in the manner described above and at appropriate distances apart to accommodate the required frame 80. Alternative objects may be hung upon the hook.

The modular wall unit may further comprise a further support member extending from the second reinforcement member. The support member may extend substantially perpendicular from the first or second reinforcement members.

Hanging Device

There is presented a hanging device 74 for supporting a frame 80. The hanging device comprises a main body 74*a* comprising an engagement region 81 for engaging a headed fixing 76 that passes through the main body 74*a*. The hanging device also comprises spaced apart first and second arms 74*b* connected to, and arranged with, the main body 74*a* to form respective first and second hook portions 74*b* for supporting the frame 80. The engagement region 81 being at least partially between the first and second hook portions.

An example of the hanging device is shown in FIGS. 12A-12D. Referring back to the hook 74 described above, the main body may be the wall portion 74*a* of the hook 74 whilst the two arms are akin to the hook portions labelled 74*b*.

The hanging device may therefore support the frame by allowing it to hang from the first and second hook portions whilst allowing a portion of the frame to extend vertically in between the first and second hook portions. Having the engagement region at least partially between the first and second hook portions allows a user to access the engagement region (for example attach/insert the headed fixing) without the hook portions being in the way. The device may be formed from separate components that are attached to each other, for example the arms may be formed separately and attached to the main body. Alternatively, the device may be unitary wherein the main body and arms are integrally formed with each other. The device may be formed from any suitable material, preferably a rigid material such as a metal or hard plastic. The device may be formed by molding or other manufacturing process.

The first and second hook portions may form a channel extending at least: A) from, and including, the first hook portion; B) to, and including, the second hook portion, wherein the engagement region faces the channel.

The section of the main body that forms the channel (with the arms) may have the engagement region. The channel may be described as 'segmented' because the main body has a wall forming one continuous side of the channel where the other side of the channel is discontinuous and formed by respective walls of the separated arms that form the hooks portions. The separation of the arms 'segmenting' at least along one of the channels side and optionally the channel base.

The side of the main body opposite to the side forming the channel may be shaped to lie adjacent to an external wall, for example an outer wall of a modular wall unit as described elsewhere herein. This side of the device may be substantially planar. The main body may have a substantially rectangular block-like shape.

The arms 74*b* may initially extend outwardly, preferably perpendicularly away, from the main body 74*a* to form the base of the channel and then turn upwardly to form the hook portions and hence a side of the channel. The point where the arms extend outwardly from the main body may be from a peripheral portion of the main body.

The channel may be open at the top proximal to where the unconnected free ends of the arms terminate. The channel may have any suitable cross-sectional channel shape, including but not limited to a J-shape, U-shape, or V-shape.

The engagement region may be recessed inwardly from a wall of the main body forming the channel. This allows the heading fixing 76, when engaged with the device, to not obstruct the frame 80 when located in the channel.

The engagement region may face the lower half of the channel. Furthermore, the engagement region may be located about a portion of the said main body channel wall that is proximal to the base of the channel.

The engagement region 81 may comprise a passage extending through the main body away from the channel. The passage may be counterbored or countersunk to accommodate the head 76*b* of the headed fixing 76 such that the head does not obstruct the frame 80 when located in the channel. The passage may be a through hole or through bore that allows the fixing 76 to pass through the main body 74*a* and engage with an external feature. The bore hole may have a longitudinal axis aligned with the bottom portion of the channel such that the headed fixing has at least a portion that is in line with, and faces, the base of the channel. When the frame is located in the channel, the frame may at least partially cover the head of the fixing, helping to prevent access to the head of the fixing. This helps prevent the unwanted removal of the device 74 from the external feature by hindering the removal of the headed fixing. The head 76*b* of the said fixing may have an outer diameter larger than the through hole thus only allowing the fixing to be removed from the device and external feature by pulling it out through the channel, in between the two arms 74*b*.

The headed fixing 76 that engages with the hanging device 74 may be a screw or a bolt. The headed fixing may act as a support member 76 (as described elsewhere herein) wherein, in FIGS. 12A-12D the main longitudinal part of the bolt/screw is akin to the 'wall portion' 76*a* of the support member 76; whilst the head is akin to the 'hook portion' 76*b* of the same support member 76.

When the headed fixing is a headed screw/bolt, the external feature may be a hole having an internal thread complementary to that of the screw. The external feature may be, for example, the 'fixing mechanism' 36 as described elsewhere herein.

The frame may comprise a first bar perpendicularly extending to and connected to a second bar wherein the said channel is for supporting the first bar. The main body may comprise a recessed second channel 83 at least partially accommodating the second bar. The recess may take the form of an elongate recess with a curved cross section shaped to flushly accommodate the vertical bar of the frame.

The wall of the main body forming part of the channel (i.e., the wall of the main body 74*a* facing the legs 74*b*) may be divided into two portions. A first portion opposing the first arm 74*b* and a second portion opposing the second arm 74*b*. The recessed second channel 83 may be located between the two said wall portions of the main body 74*a*. These two wall portions may be inclined to help form a V shape of the channel formed by the hook portions of the device. Likewise, the arms 74*b* may have an opposing inclined to the incline of the two said wall portions of the main body 74*a* so that the channel cross section (formed by the hook portions) resembles a narrowing taper extending from the open top of the channel towards the channel base.

The frame may be a grid frame as described elsewhere herein having a set or one or more first bars perpendicularly extending to and connected to a second set of one or more bars. The recessed second channel 83 may have its elongate length in a direction perpendicular to the direction of the channel formed by the hook portions.

A vertical bar of the frame may therefore, when accommodated by the device, be located in the recessed second channel 83 whilst a horizontal bar of the frame may sit in the bottom/base of the channel formed by the hook portions. When the frame 80 is in this final resting position in the device, the frame may be obstructing and/or at least partially covering the engagement region and headed fixing. Hence, at least part of the engagement region may be aligned along the length of second channel.

The engagement region may also be inwardly recessed into the main body from the second channel. This again allows the headed fixing to not obstruct the frame 80 when located in the device 74.

At least one of the arms may comprise a through hole 87. The main body 74*a* may comprise a fixing recess 85. The through hole 87 and the fixing recess 85 may be aligned such that a further fixing 78 may be inserted through the through hole 87 and at least partially into the fixing recess 85.

The through hole 87 may be proximal to the terminating free end of the said arm 74*b*. The further fixing 78, when engaged into the fixing recess 85 and extending across the top of the channel, may therefore secure the frame 80 to the device 74 and prevent the frame being lifted out from the channel. The further fixing 78 may be similar to the headed fixing described above in that it may be a bolt or a screw. The further fixing 78 is akin to the support member 78 described above. The fixing recess 85 may be a through hole through the main body 74*a* or may be a bottomed recess within the main body 74*a*. Correspondingly the further fixing 78 may pass through the main body and optionally into a further external fixing recess (for example in a wall behind the device 74 that the device backs onto and is affixed to), or may only protrude partially into the main body 74*a*. The fixing recess 85 may have an internal thread complementary to an external thread of the further fixing.

The hanging device 74 and the headed fixing may form part of a kit. The kit may also comprise any of the elements of the modular wall unit or modular wall system described elsewhere herein.

The invention claimed is:

1. A modular wall unit for a modular wall system, the modular wall unit comprising:

A) a body having:

first and second outer wall faces;

first and second joining faces that each extend between the first and second outer wall faces; at least one of the first and second joining faces for facing a joining face of a further modular wall unit of the modular wall system;

a first through-hole extending between the first and second joining faces;

B) a first elongate reinforcement member:

extending between the first joining face and the second joining face and within the first through hole;

having at least one tubular portion proximal to a terminating end of the first elongate reinforcement member, wherein the modular wall unit is configured such that:

the body further comprises an internal recess extending away from and adjoining the first through hole;

the modular wall unit further comprising an internal recess elongate reinforcement member that:

resides in the internal recess; and is connected to the first elongate reinforcement member;

wherein the modular wall unit further comprises one or more support members extending outwardly from the first or second outer wall face; and wherein the one or more support members comprises a first support member extending from the first elongate reinforcement member.

2. A modular wall unit as claimed in claim 1, further comprising:

a second through hole, spaced apart from the first through hole and extending between the first and second joining faces;

a second elongate reinforcement member:

extending between the first face and the second face and within the second through hole;

having at least one tubular portion proximal to a terminating end of the second elongate reinforcement member.

3. A modular wall unit as claimed in claim 2, wherein the one or more support members comprises a second support member extending from the second reinforcement member.

4. A modular wall unit as claimed in claim 3, wherein the first and second support members extend substantially perpendicular from the first and second reinforcement members, respectively.

5. A modular wall unit as claimed in claim 2, wherein the modular wall unit is configured such that:

the internal recess extends at least between the first through hole and the second through hole; and the second elongate reinforcement member further connects to the internal recess elongate reinforcement member.

6. A modular wall unit as claimed in claim 1, wherein the body portion comprises a foam material.

7. A modular wall unit as claimed in claim 1, wherein the part of the body portion surrounding the reinforcement members is unitary.

8. A modular wall unit as claimed in claim 1, wherein any of the said elongate reinforcement members comprise Aluminium.

9. A modular wall unit as claimed in claim 1, wherein any one or more of the first elongate reinforcement member and the internal recess elongate reinforcement member comprise a tubular portion proximal at both terminating ends.

10. A modular wall unit as claimed in claim 1, wherein any one or more of the first elongate reinforcement member and the internal recess elongate reinforcement member comprises a tube running the entire length of the respective reinforcement member.

11. A modular wall unit as claimed in claim 1, wherein the one or more support members comprises an elongate portion and a head portion terminating the one or more support members at a distal end away from the modular wall unit.

12. A modular wall unit as claimed in claim 11, wherein the elongate portion has a maximum diameter that is smaller than the maximum diameter of the head portion.

13. A modular wall unit as claimed in claim 1, wherein the first and second joining faces are planar.

14. A modular wall unit as claimed in claim 1, wherein the first and second joining faces are parallel.

15. A kit comprising:

a modular wall unit as claimed in claim 1; and one or more plugs for assembling a plurality of modular wall units.

16. A modular wall system comprising a plurality of modular wall units as claimed in claim 1.

* * * * *